US007059601B2

(12) United States Patent
Adair, Jr.

(10) Patent No.: US 7,059,601 B2
(45) Date of Patent: Jun. 13, 2006

(54) ENTERTAINMENT KIT AND ASSOCIATED METHOD OF ENTERTAINMENT

(76) Inventor: Charles Wesley Adair, Jr., 2614 N. Mission Cir., Friendswood, TX (US) 77546

( * ) Notice: Subject to any disclaimer, the term of this patent is extended or adjusted under 35 U.S.C. 154(b) by 50 days.

(21) Appl. No.: 10/321,302

(22) Filed: Dec. 16, 2002

(65) Prior Publication Data

US 2004/0198521 A1 Oct. 7, 2004

(51) Int. Cl.
*A63F 9/18* (2006.01)

(52) U.S. Cl. ..... 273/138.1; 273/139; 273/288; 273/429; 273/430; 273/431; 273/459

(58) Field of Classification Search ..... 273/153 R, 273/269, 288–291, 138.1, 139, 459, 429–432
See application file for complete search history.

(56) References Cited

U.S. PATENT DOCUMENTS

| | | | | |
|---|---|---|---|---|
| 3,770,278 | A * | 11/1973 | Mueller | 273/153 R |
| 2002/0195774 | A1* | 12/2002 | Shanahan | 273/292 |
| 2003/0225584 | A1* | 12/2003 | Kraker | 705/1 |
| 2004/0101598 | A1* | 5/2004 | Paulhus | 426/87 |

OTHER PUBLICATIONS

Edible Pursuit, Trivial Pursuit, The Washington Times newspaper, p. 3M, Sep. 26, 1985.*

* cited by examiner

*Primary Examiner*—Benjamin Layno
(74) *Attorney, Agent, or Firm*—Naman, Howell, Smith & Lee

(57) ABSTRACT

A combination snack food and game piece assemblage and method of use of same as an entertainment method.

4 Claims, 1 Drawing Sheet

ENTERTAINMENT KIT AND ASSOCIATED METHOD OF ENTERTAINMENT

BACKGROUND OF THE INVENTION

1. Field of the Invention

The present invention relates generally to entertainment, including games especially related to activities and themes associated with mysteries.

2. Background Information

Group problem-solving games are many and varied, and seem never to wane in popularity. Games from charades to the more modern "CRANIUM" are evidence of the lasting popularity of such activities.

The mystery game is a particular example of a group activity for which there are countless devotees, and among them, quite dedicated participants. In recent years, mystery games have even reached the level of participatory performance art, where guests, in many cases, spend hundreds and, in a few cases, thousands of dollars to participate in mystery "plays" in which the guests serve as actors, not fully knowing what the outcome will be. The basic concept of group mystery solving is well-entrenched among ever-popular group activities. Therefore, not unlike chess, mystery games in new formats and contexts are welcome additions to the entertainment spectrum of choices.

A (at first) seemingly unrelated activity to mystery games is that of restaurant dining. The link between mystery games and restaurant dining will, however, be made clear hereafter.

Restaurant dining has, in many households, and certainly for a majority of single individuals, overtaken home cooking as the primary manner of eating. In some ways, the modern pace of life almost dictates this trend, as dining out eliminates food preparation and clean-up time. Then, there is the attractiveness of varied menu choices, and the ambiance provided by one's favorite restaurant.

A downside to restaurant dining these days is that of the ever-increasing waiting time for one's table. It appears that the supply of restaurants does not keep pace with the demand for their services, and in cities large and small restaurant waiting times just keep growing.

Long waiting times takes its toll on all involved. Patrons often become irritable after a certain time, and frequently "take it out on" the host or hostess. Such irritability can often be contagious among guests. This, in turn, is bad for everyone. The restaurant must deal with the immediate problem of hostile guests, and the more long-term problem of those guests having less than favorable impressions of the restaurant, both for their own purposes, and for referring others to restaurants of choice. The patrons, in turn, also lose much of the benefit of dining out—time savings and enjoyment.

It might not be possible for any given restaurant to materially address waiting times—one only do just so much in rushing customers through a sit-down restaurant. However, efforts to favorably alter perceptions of waiting time are frequent and varied. Often, guests are urged to wait in a bar are (if available), and/or are provided snacks (usually peanuts, popcorn, or the like) while patrons wait for their tables. It is an additional tool or method for distracting restaurant patrons from their long table waits to which the present invention relates.

Furthermore, as will be apparent from the discussions to follow, entertainment methods and devices and herein proposed and which are useful in helping restaurant patrons pass the time while waiting for tables, can also transfer into the private home arena.

SUMMARY OF THE INVENTION

In view of the foregoing, it is an object of the present invention to provide a new combination of items which are useful in entertaining multiple individuals.

It is another object of the present invention to provide a combination of snack foods and game components for simultaneously feeding and entertaining people.

It is a further object of the present invention to provide a new and improved packaging of, or for snack foods which add entertainment features.

It is another object of the present invention to provide a combination snack food and game assemblage for entertaining restaurant patrons, particularly during long table waits.

These together with still other objects of the invention, along with the various features of novelty which characterize the invention, are pointed out with particularity in the claims annexed to and forming a part of this disclosure.

In satisfaction of the stated objects, the present invention is of a unique assemblage of snack food items and mystery game components. While the uses of such an assemblage are many, and are certainly not limited to use with restaurant patrons during long table waits, the primary impetus and expected application of the present invention is in such a context. The preferred mode of the present invention involves the combination of snack foods (fortune cookies in the preferred embodiment) with mystery game instructions and clue pieces. Once players (waiting restaurant patrons, in one instance) read instructions and successively read the clues in a prescribed order (eating the associated snack food items along the way) the players will have consumed a significant amount of (enjoyable) time while waiting for their table, thus making the wait far more pleasurable than otherwise possible. Restaurant patrons who are provided with such a pleasant distraction will be far less likely to become upset over seating delays and far more likely to leave the restaurant with an over-all favorable impression of their dining experience.

Clearly, the restaurant context is not the only one in which the assemblage and method of the present invention are applicable. The "snack-games" of the present invention will likely find popularity with hosts of parties in homes, youth groups, or even passengers of trains, airplanes or RVs.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
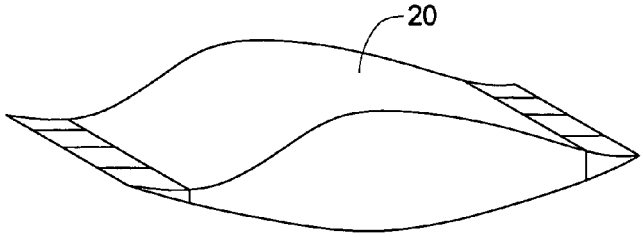
FIG. 1 is a perspective view of an individually packaged food item.
Figure 2:
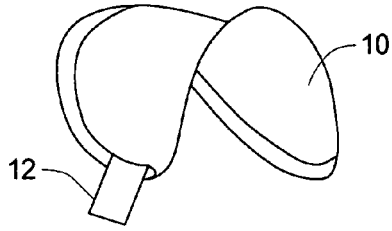
FIG. 2 is a perspective view of an individual food item with an identifying tag.
Figure 3:
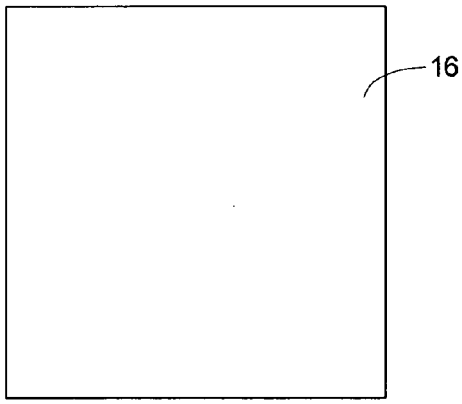
FIG. 3 is a top plan view of printed indicia instructing the users of how the game is played.
Figure 4:
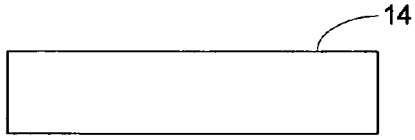
FIG. 4 is a top plan view of printed indicia providing clues associated with each food item.
Figure 5:
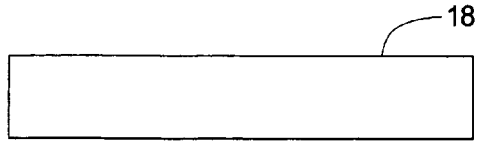
FIG. 5 is a top plan view of printed indicia bearing a description of a fictitious crime.

With reference to the instructions (16), a new combination of snack food and mystery game components embodying the principles and concepts of the present invention will be described.

The preferred embodiment of the present invention involves the combining of snack foods with written components for a mystery game. The snack foods can be just about any form of snack food, but the preferred and best believed mode involves combining the mystery game components (sheets of paper with clues, instructions, and the like) with items which can be sorted or readily accessed in a particular sequence. Examples of such snack foods can be fortune cookies and canned, formed snack chips (such as PRINGLES brand chips) (20).

In the case of fortune cookies (10), each slip of paper which contained an instruction (18), clue (14), or mystery solution, would, in the preferred embodiment, includes include some outwardly visible indicator (12) which would indicate in which category any one particular fortune cookie resides (for example, a colored tag extending from within the cookie, which, according to instructions, would tell players when the cookie's contents should be accessed). In the case of canned, pre-formed snack chips, the slips of paper may be interlaced with the chips in the order intended by the game designer. Clearly, these are merely examples of appropriate snack food choices, and alternatives will become apparent to practitioners of the present invention, upon exposure to this specification.

Exemplary instructions which follow, will enable the invention of the present combination and associated entertainment method:

Title: The Haveitall Diamonds!

Hello and thank you for playing "Chew Dunnit."

(The objective is to solve the mystery while munching on your snacks.)

Here is how to play . . .

Step 1) The characters are introduced!

Read the orange clues one at a time aloud. (All the clues can be read aloud by one person or we suggest that one orange clue per person. This way, each clue reader becomes a suspect.)

Step 2) Read the purple clue (Something terrible has happened!)

It is suggested that the person who is the character stated in the purple clue read this one.

Step 3) Read the pink clue (The mystery has been established)

It is suggested that the person who is the character stated in the red clue read this one.

Step 4) Read all the other clues . . . white, green, blue, yellow.

The clues are color coded so each character has their own clues to read aloud. (Again one person can read all the clues, if need be.) These clues are to be read in any order. We suggest everyone take turns and read one clue aloud at a time.

Step 5) Accusation time!

After all the clues are read, each person now determines who done it, and say their accusations aloud.

Step 6) Confession time!

After all the accusations are in, read the confession pages in the order in which they are marked.

Step 7) You're done! Who solved the mystery?

Who is the master detective amongst all of you?

Clearly, the story line behind any given game according to the present invention can vary in as many ways as imagination will allow. Accordingly, the supposed crime, the clues leading to the identity of the perpetrator, and the character identities will vary considerably from embodiment to embodiment of the present invention. Nevertheless, the present invention is of the combination of snack foods and game components, whether used to help people pass time, or merely to enjoy for its own sake, and of the method of entertaining carried out through the use of such combination.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

I claim:

1. A method for entertainment comprising the steps of:

providing a combination of snack food items and game components where each said game comprises a substrate having facts recited thereon, wherein a compilation of the totality of facts from all game components reveal at least a partial answer to a question previously posed as to the perpetrator of a fictitious crime, said each game component is contained in or embedded inside a snack food item, wherein said facts are hidden from view;

providing said combination to a plurality of persons whereafter said persons retrieve said game components from amidst said snack food items;

revealing said facts of said game components in a predetermined order according to color coded tags extending from within each said snack food item and game component combination, wherein the color coded tags are viewable before the game components are retrieved and revealed;

acting out prescribed steps for playing a game through use of said game components; and consuming said snack food items while playing such game.

2. The method of claim 1 wherein said snack food items are fortune cookies.

3. An entertainment kit comprising:

printed indicia instructing users of said kit in the practice of an entertainment method, pursuant to which the perpetrator of a fictitious crime is speculated by such users;

printed indicia bearing a description of said fictitious crime, the causation of which is unrevealed;

a plurality of individually packaged food items, inside each respective packaged food item is a substrate having a textual passage which reflects one or more facts, wherein said facts are hidden from view a larger compilation of which facts from the totality of facts reflected on like textual passages respectively associated with each of the constituent said individually packaged food items, constitutes an at least partial revelation of said causation of said fictitious crime; and a plurality of color coded tags extending from within each said individually packaged food item wherein said color coded tags are viewable before the individually packaged food items are opened, said color coded tags dictate the order in which each said individually packaged food item should be opened by said users.

4. The entertainment kit of claim 3 wherein said plurality of individually packaged food items are fortune cookies.

* * * * *